United States Patent [19]

Otaki et al.

[11] 4,134,252

[45] Jan. 16, 1979

[54] METHOD AND APPARATUS FOR PREPARING FALSE TWISTED YARNS

[75] Inventors: Yukio Otaki; Ken-ichiro Oka; Kazuyoshi Koide; Kiyoshi Nakagawa, all of Mishima, Japan

[73] Assignee: Toray Industries Inc., Tokyo, Japan

[21] Appl. No.: 785,539

[22] Filed: Apr. 7, 1977

[30] Foreign Application Priority Data

Apr. 10, 1976 [JP] Japan ..... 51-40482

[51] Int. Cl.[2] ..... D02G 1/08

[52] U.S. Cl. ..... 57/284; 57/290; 57/293; 57/339; 57/348

[58] Field of Search ..... 59/77.4, 77.45, 157 TS

[56] References Cited

U.S. PATENT DOCUMENTS 3,845,613 11/1974 Knebel ..... 57/77.4

4,016,715 4/1977 London, Jr. ..... 57/157 TS

FOREIGN PATENT DOCUMENTS 1419086 12/1975 United Kingdom ..... 57/77.4

*Primary Examiner*—Charles Gorenstein

*Attorney, Agent, or Firm*—Armstrong, Nikaido, Marmelstein & Kubovcik

[57] ABSTRACT

This invention relates to a method and apparatus for imparting false twists to two yarns simultaneously. The significance of the invention resides in that an industrially utilizable method for false twisting yarns by frictional contact of two yarns with 4 rotating frictional discs has been provided. The apparatus of the present invention for practising the false twisting method is characterized in that the angle of contact of yarns with the frictional discs is maintained within a specific range and the frictional discs are attached to four shafts in specific order at specific heights. Various processes for preparing a variety of false twist yarns by utilizing the false twisting method and apparatus of the present invention have been established.

14 Claims, 10 Drawing Figures

METHOD AND APPARATUS FOR PREPARING FALSE TWISTED YARNS

BACKGROUND OF THE INVENTION (1) Field of the Invention

The present invention relates to a method and apparatus for false twisting yarns by using a false twisting element including a set of 4 shafts, each shaft having at least one rotary frictional disc mounted thereon, and passing two running yarns through this false twisting element to impart false twists thereto.

(2) Description of the Prior Art

As the conventional false twisting method and apparatus, there can be mentioned so-called three-shaft false twisting method and apparatus in which one running yarn is passed through a false twisting element including a set of three shafts and frictional discs mounted on the three shafts so that they partially overlap one another.

According to this conventional false twisting technique, since only one yarn is processed by one false twisting element, the production efficiency is not sufficient, especially when large denier false twisted yarns are prepared. Moreover, crimp characteristics of the resulting processed yarns are not satisfactory.

The specification of British Patent No. 1,419,086 proposes a false twisting element comprising a set of 4 shafts, each including a rotary frictional disc mounted thereon. As illustrated in the specification, in this false twisting element, discs 11 and 11*a* are disposed at the same height. Accordingly, when two yarns are false twisted by passing them through this false twisting element, for the reasons set forth hereinafter, it is very difficult to false twist the two yarns under the substantially same processing conditions.

FIG. 1 illustrates the state of contact between a frictional disc and a yarn. In the case where a yarn 3 is not passed through a region defined by an angle 0 between the rotational direction of a frictional disc 1 and a rotational shaft 2 as shown in FIG. 1-A, the frictional force F imposed on the yarn 3 by the frictional disc 1 is divided into components $f_1$ and $f_2$. The direction of the component $f_1$ is opposite to the direction of advance of the yarn 3 indicated by arrow 3'. Accordingly, this component $f_1$ of the force acts on the yarn 3 so that the advance of the yarn 3 in the direction 3' is inhibited. This means that a large tension is imposed on the yarn 3 at the false twisting step and the yarn 3 is not easily delivered. Accordingly, in the state shown in FIG. 1-A, it is impossible to process yarns satisfactorily. In this case, the component $f_2$ of the force acts as a force of twisting yarns.

In the state shown in FIG. 1-B, the yarn 3 advances at a certain angle $\alpha$ through a region defined by an angle 0 between the rotational direction of a frictional disc 1 and a rotational shaft 2. The direction of the component $f_1$ of the frictional force F is the same as the direction of advance of the yarn 3 indicated by arrow 3'. In this case, delivery of the yarn 3 is expedited and no abnormal tension is imposed on the yarn 3. Accordingly, in this case, the yarn can be false twisted under good conditions.

In the above-mentioned false twisting element disclosed in the specification of British Patent No. 1,419,086, since two of the four frictional discs are set at the same height in four rotational shafts, if two yarns are simultaneously fed into this false twisting element, one of the two yarns is inevitably processed in the state shown in FIG. 1-A. More specifically, a force acting in the advance direction of the yarn is imposed on one yarn (the state shown in FIG. 1-B), but a force acting in a direction opposite to the yarn advance direction is imposed on the other yarn (the state shown in FIG. 1-A). In case of the yarn on which the force acting in the direction opposite to the yarn advance direction, even setting of the yarn to the false twisting apparatus is very difficult, and if the yarn is set, there are brought about considerble differences of the yarn tension (twisting or untwisting tension), twist number and the like factors between the two yarns during processing. Therefore, it is impossible to process the two yarns substantially under the same conditions. Further, depending on the quality of yarns to be processed or under some processing conditions, yarn breakage and other troubles take place and it is impossible to perform the operation stably.

As will be apparent from the foregoing illustration, in the known 4-shaft outer-contact type false twisting apparatus, the disc-yarn contact angle differs greatly between the two yarns to be processed, and therefore, the quality differs in the two yarns and one of the two yarns is not substantially even false twisted. Accordingly, such conventional false twisting apparatus can hardly be applied to a practical yarn manufacturing line.

Therefore, it has been desired in the art that the false twisting method using the above-mentioned outer-contact type false twisting apparatus will be improved so that two yarns to be processed can be false twisted simultaneously under the condition shown in FIG. 1-B and properties of both the two yarns can be made uniform or changed according to need.

OBJECTS OF THE INVENTION

It is a primary object of the present invention to provide a method for false twisting yarns in which a false twisting apparatus comprising 4 rotational shafts, each including at least one frictional disc mounted thereon, is employed and two independent yarns are simultaneously contacted with the discs of said apparatus, whereby false twisted yarns uniform in the quality can be manufactured at a high efficiency.

Another object of the present invention is to provide an apparatus for practising the above false twisting method conveniently.

Still another object of the present invention is to manufacture a variety of false twisted yarns at a high efficiency by utilizing the above false twisting method.

BRIEF SUMMARY OF THE INVENTION

In accordance with the present invention, the foregoing objects and other objects and advantages can be attained by a method for imparting false twists to yarns comprising simultaneously contacting two yarns with frictional discs of a false twisting apparatus comprising 4 rotational shafts, each including at least one frictional disc mounted thereon, wherein the frictional contact of the yarns with the frictional discs is conducted so that at contact points between the yarns and the frictional discs, angles defined by rotational directions of the discs and advance directions of the yarns are acute angles, and the resulting false twisted yarns are wound.

In accordance with the present invention, the above false twisting method is advantageously worked by an apparatus for preparing false twisting yarns by simultaneously contacting two yarns with rotating frictional discs, said apparatus comprising four rotational shafts, each including at least one frictional discs mounted thereon, said rotational shafts being disposed to form 4 apexes of a quadrilateral, respectively, wherein frictional discs mounted on adjacent two shafts are disposed stepwise so that they partially overlap each other with respect to the direction of the rotational shafts, the false twisting apparatus comprises at least four of said frictional discs, namely each rotational shaft includes at least one frictional disc, and wherein the frictional discs mounted on one set of two confronting shafts, of two sets of two confronting shafts located on the two diagonal lines of said quadrilateral, respectively, are disposed so that they partially overlap each other with respect to the direction of the rotational shafts.

DETAILED DESCRIPTION OF THE PREFERRED EMBODIMENTS

The apparatus for use in practising the method of the present invention will now be described by reference to the accompanying drawing.

Figure 2:
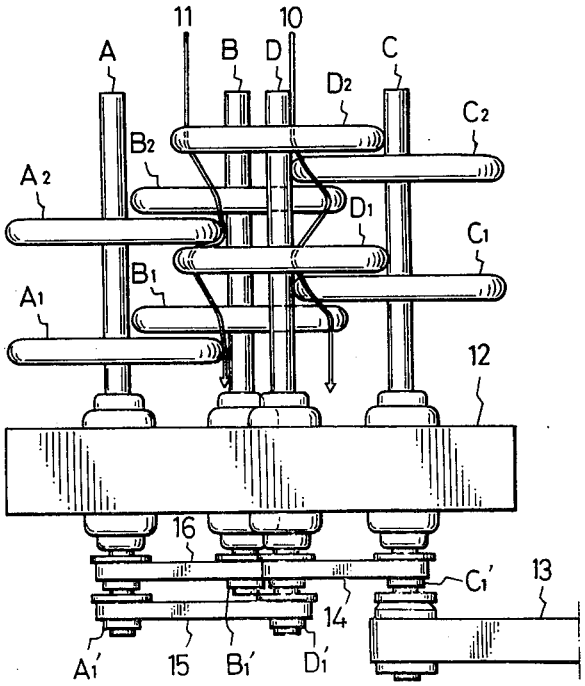
FIG. 2 is a side view illustrating one method of assembling frictional discs.

Assembling of frictional discs and arrangement of four shafts are now described by reference to FIGS. 2 and 3. Shafts A, B, C and D are mounted on a frame 12 at apexes of a quadrilateral, respectively, so that they can rotate in the same direction. Each shaft includes at least one frictional disc, for example, two frictional discs, mounted thereon. A first frictional disc $A_1$ is mounted on the shaft A, and frictional discs $B_1$, $C_1$ and $D_1$ are then mounted stepwise on the shafts B, C and D so that the frictional discs on every two rotational shafts adjacent in the clockwise direction, namely shafts B and C or C and D, partially overlap each other on the plane in the direction of the shafts. Then, a fifth frictional disc $A_2$ is mounted on the shaft A. A prescribed number of frictional discs are mounted on the shafts A, B, C and D by repeating the foregoing procedures. Frictional discs $B_1$ and $B_2$ and $D_1$ and $D_2$ mounted on the shafts B and D on the diagonal line, namely shafts not adjacent to each other, partially overlap each other, but frictional discs $A_1$ and $A_2$ and $C_1$ and $C_2$ on the other set of the rotational shafts A and C on the diagonal line are not allowed to overlap each other at all. The four rotational shafts have two points where three discs overlap one another ichonographically. That is, in a top plan view corresponding to FIG. 3, with four discs individually mounted on a separate one of the four shafts, there are constantly two points at each of which three of the four discs lie partly overlapped.

In the outer contact type frictional false twisting apparatus of the present invention, four shafts are disposed at apexes of a quadrilateral, and the above set of the rotational shafts having frictional discs not overlapping each other at all may be disposed symmetrically or asymmetrically with respect to the diagonal line connecting the set of the rotational shafts having frictional discs partially overlapping each other. However, in general, it is preferred that the quadrilateral defined by the four rotational shafts be a rhomb.

Figure 3:
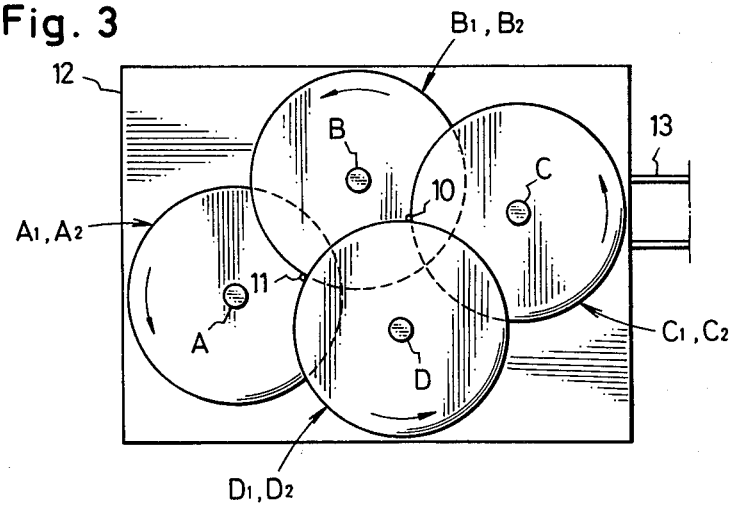
FIG. 3 is a plane view of the apparatus of FIG. 2 seen from above.

Four rotational shafts and frictional discs are assembled so that the foregoing positional relationships are established, and the four shafts are rotated counterclockwise (in the direction of an arrow in FIG. 3). Two yarns are moved while contacting them with the peripheral edges of the frictional discs mounted on the shafts B, C and D and the peripheral edges of the frictional discs mounted on the shafts A, B and D, respectively. More specifically, one yarn 10 is contacted with the frictional discs mounted on the shafts B, C and D and the other yarn 11 is contacted with the frictional discs mounted on the shafts A, B and D, whereby both the yarns are false twisted in the so-called Z direction.

When the frictional discs are arranged in the foregoing manner and the rotational direction is thereby fixed, in each of the yarns 10 and 11, the angle defined by the rotational disc and the direction of advance of the yarn at a point of contact between the frictional disc and the yarn, namely the so-called contact angle ($\alpha$ in FIG. 1-B), is an acute angle smaller than 90°, whereby a good twisting effect and a positive yarn feed effect can be attained and the merits of the 4-shaft outer contact type frictional false twisting apparatus can be exerted sufficiently.

In the case where it is desired to obtain processed yarns twisted in the S direction, the frictional discs are arranged so that they rotate in the counterclockwise direction (for example, A→D→C→B→A . . . if started from the shaft A) and the rotational direction of the four shafts is adjusted to the clockwise direction. Of course, the starting shaft need not be limited to the shaft A, and the operation may be started from any of the four shaft, as long as the frictional discs are assembled in the foregoing manner.

In another embodiment of the present invention, 9 frictional discs are disposed so that the operation starts from the shaft D and ends at the shaft D. In this embodiment, the frictional disc with which the yarns 10 and 11 are first contacts and the frictional disc with which the two yarns 10 and 11 are last contacted are mounted on the same shaft, and the relative position between the yarn and the yarn-contacting frictional disc is substantially the same between the yarns 10 and 11. Accordingly, yarns having equivalent properties can be obtained.

In the apparatus shown in FIGS. 2 and 4, the mechanism for rotating the four shafts A, B, C and D in the same direction is disposed below the frame 12. This mechanism will now be described by reference to FIG. 5. A rotational power from a power source (not shown) is transmitted to a roller attached to one of the foregoing four shafts, for example, a roller $C_1'$ attached to the shaft C, through a belt 13. Rollers $D_1'$, $A_1'$ and $B_1'$ are mounted on the shafts D, A and B, respectively, and rollers $C_1'$ and $D_1'$, rollers $D_1'$ and $A_1'$ and rollers $A_1'$ and $B_1'$ are connected to each other by belts 14, 15 and 16, respectively, so that all the rollers are rotated in the same direction. As not specifically disclosed in the drawing, on the rotation shaft on which two belts are hung, a roller having a broader width or two rollers are attached. By this arrangement, all the frictional discs are allowed to turn in the same direction. In this embodiment, it is indispensable that each belt is arranged so as to connect rollers of two adjacent rotational shafts.

Any of materials having a high friction coefficient can be used for the frictional discs. Use of rubbery, ceramic or metallic materials is especially preferred. Of course, several materials differing in the kind may be used in combination.

Setting of yarns on the 4-shaft frictional disc type false twisting apparatus of the present invention can be accomplished by various methods. For example, the following methods can be utilized:

(1) Shafts (shafts A and C) on which frictional discs not overlapping each other are mounted are arranged so that they can be opened to the left and right and yarns are introduced through the opening.

(2) The four shafts are arranged so that the quadrilateral defined by them can be enlarged to a similar figure and yarns are inserted therein.

(3) Yarn setting methods customarily adopted for conventional 3-shaft outer contact type false twisting apparatuses may be adopted.

Yarns composed of ordinary thermoplastic polymers such as polyamides, polyesters, polyacrylic resins and polyolefins can be processed according to the present invention.

The present invention can be applied to not only the conventional false twisting system where drawn yarns are false twisted but also other newly developed false twisting systems where undrawn yarns (inclusive of highly oriented yarns) are false twisted subsequently or simultaneously with drawing.

The false twisting is carried out at a speed of at least 200 m/min, preferably at least 300 m/min. Yarns having a small denier before doubling can be processed. Accordingly, also from the view point of the heat setting effect, the present invention can be advantageously applied to the high speed processing.

Embodiments and modifications for practical working of the method and apparatus of the present invention, of which basic features have hereinbefore been illustrated, will now be described in detail.

According to one practical embodiment of the present invention, doubled yarns composed of twisted yarns can be prepared by performing false twisting by using a 4-shaft outer contact type frictional false twisting apparatus of the present invention equipped with frictional discs capable of simultaneously and independently false twisting two yarns, doubling two yarns processed by one unit of said false twisting apparatus or doubling one of the two yarns processed by one unit of said false twisting apparatus and one of the two yarns processed by the other unit of said false twisting apparatus, and winding one doubled yarn substantially per unit of said false twisting apparatus. The process comprising doubling two yarns from one unit will be designated hereinafter as "process A," and the process comprising doubling two yarns from two units will be called "process B" hereinafter.

According to another practical embodiment of the present invention, non-torque yarns can be prepared by disposing units of a 4-shaft outer contact type frictional false twisting apparatus of the present invention equipped with frictional discs capable of simultaneously and independently false twisting two yarns, so that S and Z twists can be imparted to yarns alternately in the units of said false twisting apparatus, doubling one of the two yarns false twisted in the same direction by one unit of said false twisting apparatus and one of the two yarns false twisted in the reverse direction by the adjacent unit of said false twisting apparatus, and winding one doubled yarn substantially per unit of said false twisting apparatus. This process will be designated as "process C" hereinafter.

According to still another practical embodiment of the present invention, special bukly yarns can be prepared by using a 4-shaft outer contact type frictional false twisting apparatus of the present invention equipped with frictional discs capable of simultaneously and independently false twisting two yarns, independently false twisting two yarns different in properties, doubling the false twisted yarns and winding substantially one yarn. This process will be designated as "process D" hereinafter.

According to a further practical embodiment of the present invention, bulky yarns can be prepared by disposing units of a 4-shaft outer contact type frictional false twisting apparatus of the present invention equipped with frictional discs capable of simultaneously and independently false twisting two yarns, so that properties of the frictional discs are changed alternately in the units of said false twisting apparatus, doubling one of the two yarns false twisted by one units of said false twisting apparatus and one of the two yarns false twisted by the adjacent unit of said false twisting apparatus, winding one doubled yarn substantially per unit of said false twisting apparatus. This process will be designated as "process E" hereinafter.

Figure 9:
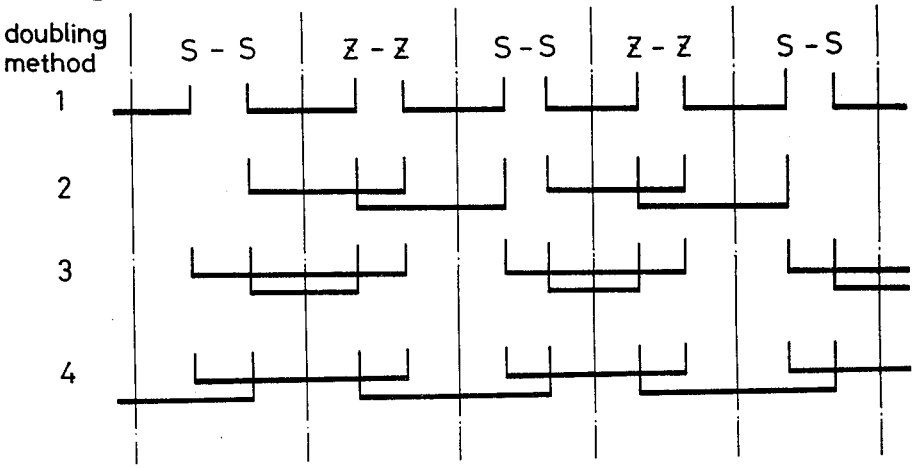
FIG. 9 is a view illustrating the doubling method adopted in the processes A, B, C, D and E.

As the applicable doubling method, there may be considered 4 methods shown in FIG. 9, which will be detailed hereinafter. Any of these methods can be adopted in the present invention. However, a method in which yarns from two adjacent units are doubled is most preferred because yarn passages are most simplified in this method. In FIG. 9, symbols S—S and Z—Z indicate that S twists and Z twists are given to yarns in the designated units, respectively. Of course, according to the present invention, doubling can be accomplished even when S twists or Z twists alone are imparted to yarns in all the units.

Further, in any of the foregoing processes, if single yarns are entangled, the gathering properties of the yarns after doubling can be remarkably improved. Especially good results are obtained when doubled yarns are treated with gathering means such as an air injection nozzle to cause entanglement among yarn filaments. When yarns of S twists and Z twists are doubled, the torques of the S twist yarn and Z twist yarn are well balanced with each other and apparently non-torque yarns can be obtained. According to this process, non-torque yarns having satisfactory properties are obtained, but if it is desired to moderate or eliminate the stretchability imparted by crimping, the object can be attained effectively by conducting the heat treatment after doubling.

The foregoing single yarn entanglement treatment or heat treatment may be performed on one of the yarns to be doubled or on both the yarns. Moreover, both the foregoing two treatments may be carried out in succession in an optional order. Still further, these treatment may be carried out on single yarns before doubling.

As a result of various experiments made by us, it was found that when the false twisting operation is carried out by using a 4-shaft outer contact type frictional false twisting apparatus, the following conditions be satisfied with respect to the yarn denier (D) and the filament number (N):

$D \geqq 100$ and $N \geqq 30$.

It has been confirmed that if the false twisting operation is carried out so that the foregoing conditions are satisfied, the number of fluffs can be remarkably reduced. Incidentally, the yarn denier D represents a total deniel of a processed yarn formed by false twisting and subsequent doubling. If a doubled yarn is subjected to the heat treatment, the denier D represents the total denier of the doubled yarn before the heat treatment. Values of the denier D are those measured under a load of 0.1 g/d.

Figure 6:
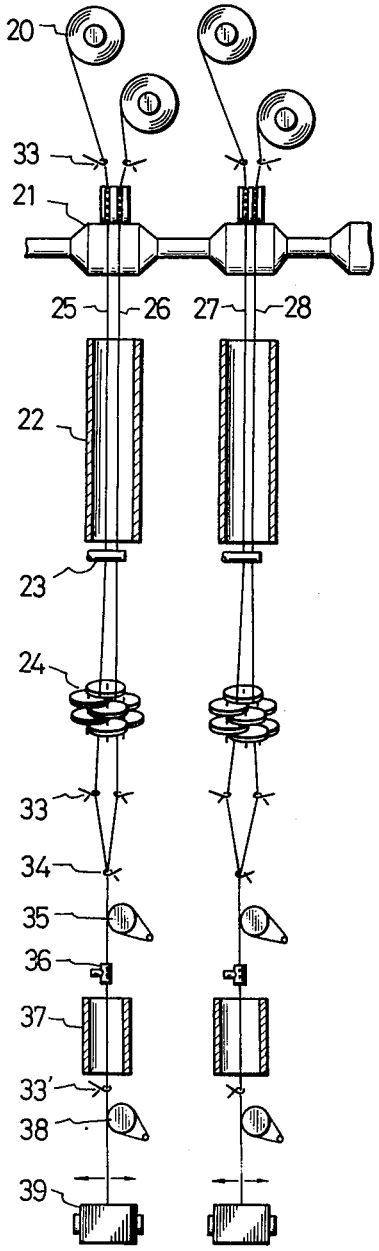
FIGS. 6, 7 and 8 are flow sheets of processes A, B, C, D and E to which the present invention is applied (these processes A, B, C, D and E will be described hereinafter).
Figure 7:
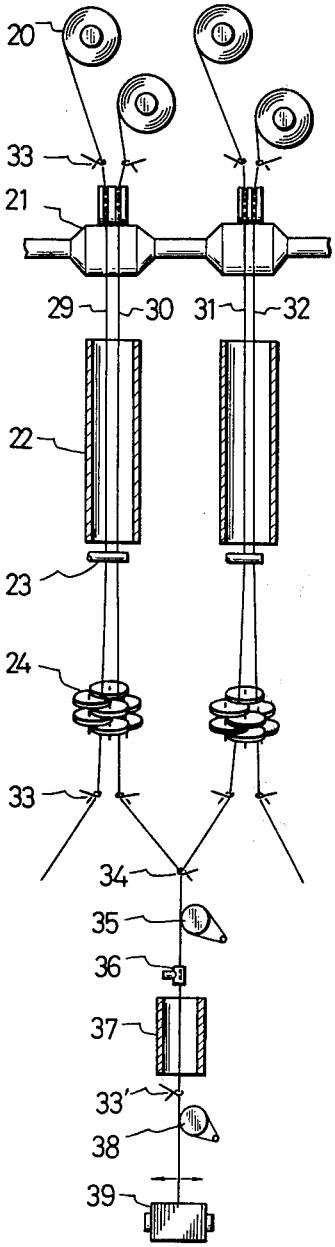

The foregoing processes A to E will now be described in detail by reference to the accompanying drawing. Process A (doubling of two yarns from one unit) and Process B (doubling of two yarns from two adjacent units):

FIG. 6 illustrates diagrammatically the system for doubling two yarns processed in one false twisting unit, and FIG. 7 illustrates diagrammatically the system for doubling two yarns processed by two adjacent false twisting units.

In FIGS. 6 and 7, reference numeral 20 represents a yarn package, 21 a yarn feed device (first roller), 22 a heat treatment device for fixing twists on the yarn, 23 a pressing guide for contacting the yarn with the heat treatment device 22, 24 a 4-shaft outer contact type frictional false twisting apparatus according to the present invention. 25 to 32 yarns, 33 and 33' guides, 34 a doubling guide for doubling two yarns, 35 a second roller, 36 a gathering or entangling device for entangling single yarn flaments with one other, 37 a heat treatment device, 38 a third roller, and reference numeral 39 represents a winding device.

The processes A and B are characterized by using a false twisting system comprising one unit 24 of a 4-shaft outer contact type frictional false twisting apparatus capable of simultaneously and independently false twisting two yarns, doubling means 34 and winding means 39 for winding a doubled yarn, wherein one doubled yarn can be wound substantially per unit of the false twisting apparatus. If the doubling guide 34 is omitted in FIGS. 6 and 7, the gathering device 36 acts as the doubling means, and if members 34, 36 and 37 are omitted, the member 33' acts as the doubling means.

In the twisting system illustrated in FIG. 7, if a number of false twisting units are arranged in the horizontal direction, one of two yarns false twisted by each of the leftmost and rightmost units has not another yarn to be paired. Accordingly, the relation of $n=N-1$ is established between the number N of the false twisting units and the number n of the winding device, but in the present invention, also this feature satisfies the requirement that one doubled yarn is wound substantially per unit.

Process C

The process C for preparing non-torque yarns according to the present invention will now be described by reference to FIG. 8.

Figure 8:
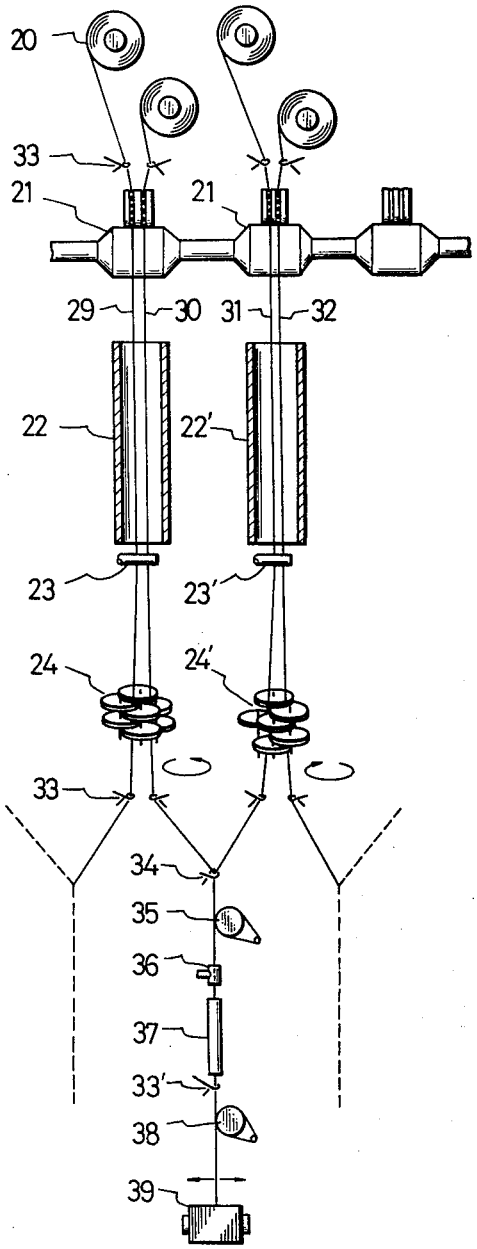

Referring to FIG. 8, a yarn taken out of a yarn package 20 is paired with a yarn taken out of another yarn package 20, and the two yarns are fed from feed devices 21 and false twisted by units 24 and 24' of a 4-shaft outer contact type frictional false twisting apparatus. The imparted twists are fixed by heat treatment devices 22 and 22'. The yarns are sufficiently contacted with the heat treatment devices 22 and 22' by pressing guides 23. Reference numeral 33 represents a guide. In the false twisting units 24 and 24', the rotational direction of frictional discs and the order of attachment of frictional discs to shafts are reversed so that opposite twists are imparted to the yarns, respectively, in the twisting units 24 and 24'. More specifically, if Z twists are imparted to the yarn in the false twisting unit 24, the Z-twisted yarns 29 and 30 are doubled with S-twisted yarns from adjacent units. Namely, the Z-twisted yarn 30 is doubled with the S-twisted yarn 31 of the adjacent unit, the Z-twisted yarn 29 is doubled with the S-twisted yarn from the left unit (not shown), and the S-twisted yarn 32 is doubled with the Z-twisted yarn from the right unit (not shown).

Doubled yarns formed in the foregoing manner are passed through single yarn entangling devices 36 or heat treatment devices 37 according to need, and they are wound on winding devices 39. Reference numerals 35, 38 and 34 represent a second roller, a third roller and a gathering guide, respectively.

In FIG. 8, if a number of false twisting units are arranged in the horizontal direction, one of yarns processed by each of the rightmost and leftmost units has not another yarn to be paired, and a relation of $n=N-1$ is established the number N of the false twisting units and the number n of the winding devices. As in the case of the process B, in the present invention, this feature satisfies the requirement that one doubled yarn is wound substantially per unit.

In practising the process C, doubling methods as shown in FIG. 9 may be adopted. In FIG. 9, symbols S—S and Z—Z are as explained hereinbefore.

Process D

The process D is characterized in that false twisted yarns having a special touch or feel by doubling two yarns differing in properties, especially the kind and properties of the yarn-constituting organic polymer, and yarn properties such as the denier and dyeability. Any of false twisting systems used for the foregoing processes A, B and C can be used for practising the process D. Further, any of doubling methods shown in FIG. 9 can be adopted.

Examples of combinations of two yarns different in properties, that are doubled according to this process, are shown in Table 1.

Table 1

| Difference | Example | Attained Effect |
|---|---|---|
| Polymer | PET/polyamide | migration effect |
| Denier | 75-36/75-18, 150-30/75-18 | improvement of touch by mixing of yarns differing in crimp number |
| Cross-Section | circular cross-section/tri- | improvement of gloss |

Table 1-continued

| Difference | Example | Attained Effect |
|---|---|---|
| of Yarn | angular cross-section | |
| Dyeability | PET/modified PET | migration effect |
| Melting Point | PET/modified PET, PET/polyamide | improvement of surface touch |
| Intrinsic Viscosity | PET of intrinsic viscosity of 0.63/PET of intrinsic viscosity of 0.48 | improvement of surface touch |
| Orientation | yarn of $\Delta n=35 \times 10^{-3}$/yarn of $\Delta n=25 \times 10^{-3}$ | improvement of touch by mixing of yarns differing in crimp number of yarn length |
| Shrinkability | PET/modified PET | improvement of bulkiness by diffence of yarn length |

In the process D, the single yarn entangling treatment or heat treatment may be carried out after or simultaneously with doubling. These treatments may be conducted on either or both of the two yarns to be doubled, and the order of these treatments is not particularly critical. By such treatments, it is possible to improve the gathering property of the yarn or to adjust the bulkiness or shrinkage percent. Therefore, these treatments are conducted according to need. In order to improve the gathering property, it is preferred to conduct the single yarn entangling treatment. In general, these treatments are conducted between the false twisting unit and the winding device.

Process E

The process E is characterized in that properties of the frictional discs are changed in two units of the false twisting apparatus of the present invention. Accordingly, any of twisting systems shown in FIGS. 6 to 8 may be adopted for practising the process E, and any of doubling methods shown in FIG. 9 can be adopted.

Specific means for changing properties of the frictional discs in two twisting units are as follows:

(1) Numbers of frictional discs are changed (for example, 9 discs are attached to the unit 24 and 6 discs are attached to the unit 24').

(2) Diameters of frictional discs are changed (for example, discs having a diameter of 50 mm are used for the unit 24 and discs having a diameter of 40 mm are used for the unit 24').

(3) Thicknesses of frictional discs are changed (for example, discs having a thickness of 7 mm are used for the unit 24 and discs having a thickness of 4 mm are used for the unit 24').

(4) Distances between frictional discs on the same shaft are changed (for example, the disc distance is adjusted to 1.0 mm in the unit 24 and the disc distance is adjusted to 0.5 mm in the unit 24').

(5) Distances between two adjacent shafts are changed (for example, the shaft distance is adjusted to 40 mm in the unit 24 and the shaft distance is adjusted to 35 mm in the unit 24').

(6) Disc-constituting materials are changed (for example, discs composed of a rubbery material are used for the unit 24 and discs composed of a ceramic material are used for the unit 24').

These means (1) to (6) may be adopted singly or in combination. If any of means (1) to (6) is adopted, a larger number of twists are imparted by the unit 24 than by the unit 24'.

The false twisting method and apparatus of the present invention having the above-illustrated characteristic features can attain the following effect:

(a) Since two yarns can be simultaneously and independently false twisted by using only one false twisting apparatus comprising 4 shafts, each including at least one frictional disc, two processed yarns can be manufactured per unit. Accordingly, the manufacturing efficiency and productivity can be highly improved over the conventional techniques, and the manufacturing cost can be reduced.

(b) Each of two yarns to be simultaneously and independently processed is false twisted substantially by a three-shaft outer contact type false twisting system, and therefore, the twisting effect, feed effect, running stability, adaptability to high speed processing and operating conditions (especially easiness in the yarn-setting operation) can be highly improved over the conventional frictional false twisting techniques and processed yarns having high quality with much less damages or defects can be obtained.

Figure 1A:
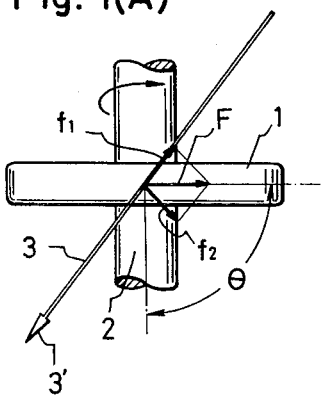
FIGS. 1-A and 1-B are conceptive diagram illustrating the state of contact between the frictional disc and yarn in a false twisting apparatus and the vecter of force acting on the yarn.
Figure 1B:
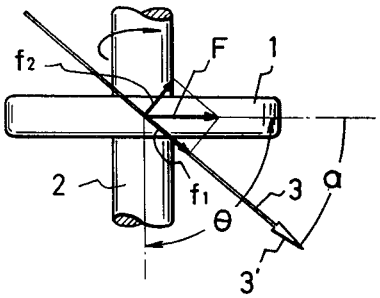

In the above-mentioned 4-shaft false twisting apparatus disclosed in the specification of British Patent No. 1,419,086, one of two yarns can be processed into a good quality yarn (FIG. 1-B) but in case of the other yarn, the contact angle between the yarn and the frictional disc is larger than 90° (FIG. 1-A). Accordingly, no feed effect is attained and the tension on the yarn coming from the false twisting apparatus is very high. Therefore, merits of the three-shaft frictional false twisting system cannot be exerted at all and even yarn-setting becomes difficult. The 4-shaft false twisting apparatus of the present invention makes it possible for the first time to process both of two yarns simultaneously by utilizing merits of the three-shaft frictional false twisting system effectively, and two processed yarns having high quality can be simultaneously obtained according to the present invention.

It is expected that the following effects can be attained by the above-mentioned processes A to D in which two yarns are simultaneously false twisted by the 4-shaft outer contact type frictional false twisting apparatus of the present invention and two processed yarns from one false twisting unit or from two adjacent false twisting units are doubled. invention.

(c) Since two processed yarns are doubled, namely since a yarn having a large denier is not directly processed but two yarns small in the denier are separately but simultaneously false twisted, the twisting efficiency is especially high and a processed yarn uniform in the quality can be prepared at a high efficiency.

(d) Since two yarns can be false twisted by one unit of the false twisting apparatus, the false twisting line can be simplified and a distance between two adjacent units can be broadened.

(e) Although two units of the false twisting apparatus are necessary for obtaining one doubled yarn according to the conventional methods, according to the present invention, two yarns can be doubled by provision of one unit of the false twisting apparatus, and therefore, the equipment cost can be lowered and doubled yarns can be manufactured at a low cost.

Still further, according to the processes A to E of the present invention, the following advantages can be attained:

(f) When two yarns having the same denier are doubled, since twists are imparted to yarns having a denier substantially ½ of the denier of the resulting doubled yarn, very fine and excellent crimps can be imparted to the resulting doubled yarn.

(g) According to the present invention, it is possible to perform high speed processing. In the case where it is desired to obtain false twisted yarns having a denier of 150, according to the present invention, two yarns having a denier of 150 are first false twisted and then, they are doubled. Since the yarn having a denier of 75 has a size smaller than that of the yarn having a denier of 150, the heat from a false twisting hot plate is more effectively conducted to the yarn having a denier of 75 and a higher heat setting efficiency can be attained. In other words, in case of the yarn having a denier of 75, the processing speed can be enhanced.

(h) Since yarns having a lower denier are false twisted, the fatal defect involved in the conventional methods, namely the defect of generation of fluffs, can be effectively eliminated, and a false twisted yarn having a large total denier and a large filament number can be advantageously prepared.

The present invention will now be described in detail by reference to the following Examples that by no means limit the scope of the present invention.

EXAMPLE 1

Two yarns of 140 denier/36 filaments taken out at a rate of 3000 m/min. were simultaneously and independently processed under conditions described below by using the false twisting apparatus of the present invention disclosed in FIG. 2.

Processing method: simultaneous drawing and false twisting

Processing speed 600 m/min.

Draw rate: 1.90

False twisting apparatus: 4-shaft outer contact type; 8 frictional discs composed of a urethane rubber Two good processed yarns of 75 denier/36 filaments having properties shown in Table 2 were simultaneously obtained. In Table 2, the value of the number of fluffs was one determined by using a fluff counter Model L-DT104-01 manufactured by Toray Industries Incorporated.

Table 2

| | Yarn 10 | Yarn 11 |
|---|---|---|
| Twist number | 3480 T/M | 3420 T/M |
| Fluff number | 0/10000 M | 0/10000M |
| Untwisting | not observed | not observed |
| Strength | 4.3 g/d | 4.3 g/d |
| Elongation | 23% | 23% |
| Twist direction | Z | Z |

EXAMPLE 2

Figure 4:
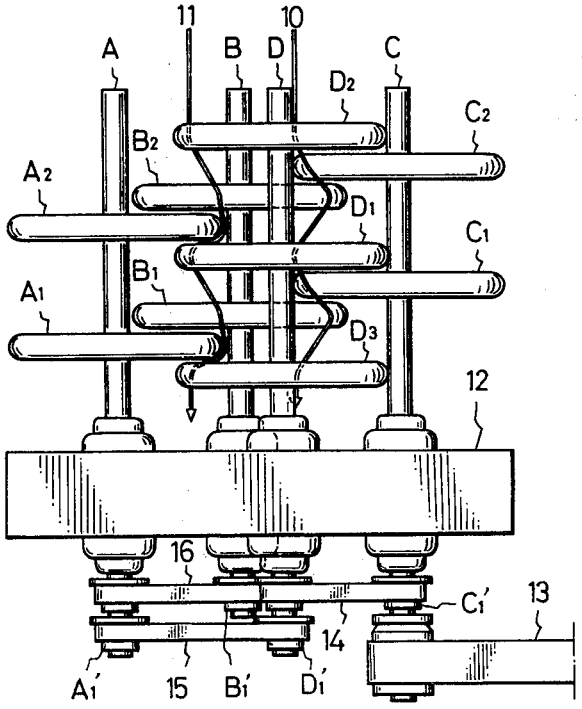
FIG. 4 is a side view illustrating another method of assembling frictional discs.
Figure 5:
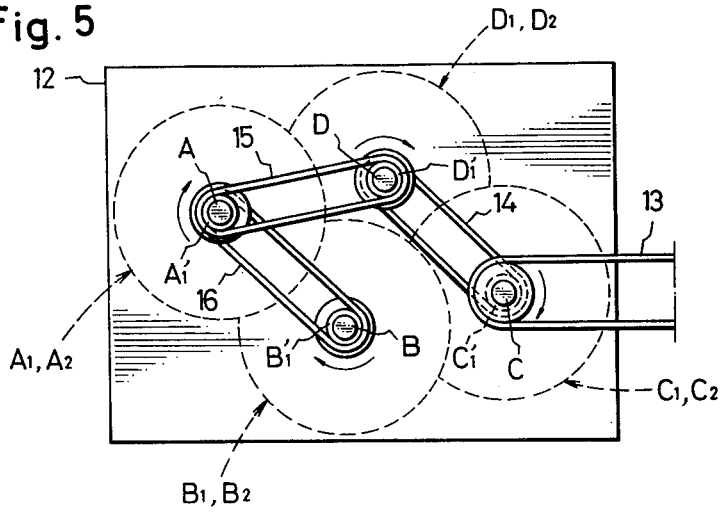
FIG. 5 is a bottom view illustrating the unit for driving 4 rotational shafts.

Under the same conditions as described in Example 1, two yarns same as used in Example 1 were simultaneously processed by using the 4-shaft false twisting apparatus of the present invention shown in FIG. 4. Two yarns having properties shown in Table 3 were simultaneously obtained. From results shown in Table 3, it will readily be understood that the two yarns were equivalent to each other with respect to the properties.

Table 3

| | Yarn 1 | Yarn 2 |
|---|---|---|
| Twist number | 3510 T/M | 3500 M/T |
| Fluff number | 0/1000 M | 0/1000 M |
| Untwisting | not observed | not observed |
| strength | 4.1 g/d | 4.1 g/d |
| Elongation | 22% | 22% |
| Twist direction | Z | Z |

As will be apparent from the foregoing Examples, processed yarns obtained by using the false twisting apparatus of the present invention have properties substantially the same as those of yarns obtained by using a three-shaft outer contact type false twisting apparatus including frictional discs, and two yarns can be simultaneously processed by one unit of the apparatus. Therefore, the productivity can be remarkably enhanced according to the present invention. Moreover, in the apparatus of the present invention, the numbers of shafts, frictional discs and parts of the driving system can be reduced over the conventional apparatuses. Therefore, the manufacturing cost of the apparatus can be lowered and the handling and maintenance characteristics of the apparatus of the present invention can be remarkably improved over the conventional apparatuses.

EXAMPLE 3

This Example illustrates the above-mentioned process. A comprising doubling two yarns processed in one twisting unit.

Two preoriented yarns ($\Delta n = 31 \times 10^{-3}$) of polyethylene terephthalate filaments (145 denier/36 filaments) were fed at a rate of 316 m/min. to the 4-shaft outer contact frictional false twisting apparatus of the present invention, and they were false twisted while they were drawn at a draw ratio of 1.90. The processing speed was 600 m/min. A hot plate used for fixing twists had a length of 2.4 m and was maintained at 210° C. Frictional discs attached to the false twisting apparatus were composed of a urethane rubber and were rotated at 6200 rpm. The twist numbers of the simultaneously false twisted two yarns were 3650 turns/m and 3730 turns/m, respectively. They were doubled without being wound separately, and the resulting doubled yarn was wound.

The resulting doubled yarn was a stretchable bulky yarn having fine crimps, which was characterized by a denier of 154.1, a filament number of 72, a strength of 4.6 g/d and an elongation of 16.6%.

EXAMPLE 4

Also this Example illustrates the process A comprising doubling two yarns false twisted by one false twisting apparatus.

Under the same conditions as described in Example 3, the false twisting and doubling treatments were carried out. The resulting doubled yarn was subjected to the single yarn entanglement treatment by jetting air under a pressure of 8 kg/cm$^2$ by using an interlacing nozzle. Then, the yarn was heat-treated by passing it through a hollow heating plate having a length of 1.5 m and maintained at 190° C. under an overfeed of 10% between second and third rollers. The resulting yarn was a type processed yarn of 159.6 denier/72 filaments having a much reduced torque.

EXAMPLE 5

Also this Example illustrates the process A comprising doubling two yarns false twisted by one false twisting apparatus.

The following three methods were conducted to obtain false twisted yarns of 150 denier/72 filaments.

Control 1

Highly oriented polyester yarn of 285 denier/72 filaments taken out at a spinning speed of 3000 m/min. was subjected to the conventinal false twisting processing. According to this method, one yarn was obtained per false twisting unit.

Control 2

Two highly oriented polyester yarns of 142 denier/36 filaments taken out at a spinning speed of 3000 m/min. were separately false twisted by using two units of the conventional false twisting apparatus, and the resulting two false twisted yarns were doubled. According to this method, one yarn was obtained per two twisting units.

Process A

Two highly oriented polyester yarns of 142 denier/36 filaments taken out at a spinning speed of 3000 m/min. were simultaneously and independently processed by using one unit of the 4-shaft outer contact type false twisting apparatus of the present invention. Then, the resulting two false twisted yarns were doubled. According to this method, one yarn was obtained per twisting unit.

In each method, the draw ratio was 1.90, processing speed was 600 m/min., and simultaneous drawing and false twisting were effected. Properties of the obtained yarns are shown in Table 4. In Table 4, the value of CR, which indicates the crimp recovery, was one determined according to the following formula:

$$CR\ (\%) = \frac{La - Lb}{La} \times 100$$

More specifically, a 10-wound hank was treated for 20 minutes in warm water maintained at 90° C. Then, the sample was allowed to stand still for 24 hours to effect natural drying. Then, a load (g) corresponding to 1/25 of the nominal denier and a load two times the nominal denier were imposed on both the ends of the sample, and the length (La) of the sample was measured. Then, the load two times the nominal denier was removed, and the length (Lb) of the sample was measured. The CR value was calculated from the thus measured values of La and Lb according to the above formula.

Table 4

| | Twist Number (T/M) | Fluff Number | CR Value | Number of Processed Yarns per 100 units |
|---|---|---|---|---|
| Control 1 | 2450 | 50/10000 M | 45 | 100 |
| Control 2 | 3450 | 0/10000 M | 50 | 50 |
| Process A | 3450 | 0/10000 M | 50 | 100 |

From the above results, it is seen that the product obtained in the process A according to the present invention was excellent over the product obtained in Control 1 with respect to the number of fluffs and the CR value indicating the crimp characteristics. Further, according to the process A, the manufacturing rate was two times the manufacturing rate attained in the method of Control 2.

EXAMPLE 6

This Example illustrates the process B comprising doubling two yarns false twisted by two false twisting units.

The following 8 kinds of yarns were prepared by doubling two yarns false twisted at a processing speed of 600 m/min. and a draw ratio of 1.90 by simultaneous drawing and false twisting according to the present invention. For comparison, the same kinds of yarns were prepared according to the customary technique without conducting doubling. Obtained results are shown in Table 5.

Table 5

| | | Present Invention | | | Comparison | | |
|---|---|---|---|---|---|---|---|
| Run No. | Kind (denier/filaments) | Twist Number (T/M) | Fluff Number (per 10000 M | CR Value | Twist Number (T/M) | Fluff Number (per 10000 M) | CR Value |
| 1 | 150/20 | 3450 | 0 | 50 | 2450 | 0 | 47 |
| 2 | 150/30 | 3480 | 0 | 52 | 2430 | 5 | 46 |
| 3 | 150/48 | 3500 | 0 | 52 | 2470 | 30 | 45 |
| 4 | 150/72 | 3450 | 0 | 51 | 2450 | 50 | 45 |
| 5 | 120/48 | 3800 | 0 | 52 | 2680 | 5 | 47 |
| 6 | 80/36 | 4400 | 0 | 55 | 3280 | 0 | 52 |
| 7 | 75/36 | 4700 | 0 | 55 | 3450 | 0 | 52 |

In Runs Nos. 2, 3, 4 and 5, the present invention was highly effective over the comparative method. In Runs Nos. 1, 6 and 7, the crimp characteristics were improved by the present invention, but no substantial improvement of the quality of the processed yarn was attained. Thus, it will be apparent that it is on yarns having a large filament number and a large denier that the present invention attains excellent effects.

EXAMPLE 7

This Example illustrates the above-mentioned process C of the present invention.

Preoriented yarns ($\Delta n = 31 \times 10^{-3}$) of polyethylene terephthalate fibers of 145 denier/36 filaments were alternately set to the 4-shaft outer contact type frictional false twisting apparatus shown in FIG. 3 and the other 4-shaft outer contact type frictional false twisting apparatus in which the direction and arrangement state of the frictional discs were reversed to those shown in FIG. 3. The yarn feed rate was 314 m/min. The yarns were false twisted while they were being drawn at a processing speed of 600 m/min. (draw ratio = 1.91). A hot plate having a length of 2.4 m and maintained at 210° C. was used for fixing twists. In each of the false twisting apparatuses, 2 frictional discs composed of a urethane rubber were attached to each of the 4 shafts. The rotation number of the discs was 6800 rpm. One of two yarns of Z twists and one of yarns of S twists were doubled according to the method 1 shown in FIG. 9, and the doubled yarn was wound.

The resulting yarn was an elastic bulky yarn of 152.2 denier/72 filaments substantially free of a torque and having very fine crimps.

EXAMPLE 8

Also this Example illustrates the process C of the present invention.

The false twisting and doubling treatments were carried out under the same conditions as in Example 7. The resulting doubled yarn was subjected to the single yarn entanglement treatment under an air pressure of 8 kg/cm$^2$ by using an interlacing nozzle (36 in FIG. 8) and then, the yarn was passed through a hollow hot plate having a length of 1.5 m and maintained at 190° C. under an overfeed of 10% and was then wound.

The resulting yarn of 160.8 denier/72 filaments was substantially free of a torque and had finer and more uniform crimps than those of the yarn obtained in Example 7. The yarn had a low stretchability and a good gathering property.

EXAMPLE 9

Also this Example illustrates the process C of the present invention.

In the drawing system shown in FIG. 8, units of the 4-shaft frictional false twisting apparatus were arranged alternately. Polyethylene terephthalate yarns indicated in Table 6 were fed at a feed rate of 314 m/min. and were drawn-false twisted at a rate 600 m/min. A hot plate having a length of 2.4 m and maintained at 210° C. was used for fixing twists. In each false twisting apparatus, frictional discs composed of a urethane rubber were attached to each shaft, and the rotation number was 6800 rpm. One of two yarns of Z twists and one of yarns of S twists were doubled according to the method 1 illustrated in FIG. 9.

Properties of the resulting processed yarns are shown in Table 6. Each of the so obtained processed yarns was a stretchable bulky yarn substantially free of a torque and having fine crimps.

For comparison, corresponding processed yarns were prepared according to the conventional process not performing doubling. Obtained results are shown in Table 7.

In Tables 6 and 7, the value of CR was determined according to the method described in Example 5. The torque twist number (twist number/50 cm) was determined in the following manner. A sample of the yarn having a length of 1 m was collected under a load (g) corresponding to 1/10 of the nominal denier, and a load (g) corresponding to 2/1000 of the nominal denier was imposed on the center of the sampled yarn to fold the yarn. The number of twists generated by the above operation was counted.

Table 6

| Results Obtained According to Present Invention | | | | | | | |
|---|---|---|---|---|---|---|---|
| | Run 1 | Run 2 | Run 3 | Run 4 | Run 5 | Run 6 | Run 7 |
| Doubled Yarn (denier/filaments) | 150/20 | 150/30 | 150/48 | 150/72 | 120/48 | 80/36 | 75/36 |
| Starting Yarn (denier/filaments) | 145/10, two yarns | 145/15, two yarns | 145/24, two yarns | 145/36, two yarns | 117/24, two yarns | 78/18, two yarns | 63/18. two yarns |
| Twist Number (T/M) | 3450 | 3480 | 3500 | 3450 | 3800 | 4400 | 4700 |
| Number of Fluffs (per 1000 M) | 0 | 0 | 0 | 0 | 0 | 0 | 0 |
| CR (%) | 50 | 52 | 52 | 51 | 52 | 55 | 55 |
| Torque Twist Number (T/50M) | 0 | 0 | 0 | 0 | 0 | 0 | 0 |

Table 7

| Results Obtained According to Conventional Method | | | | | | | |
|---|---|---|---|---|---|---|---|
| | Run 1' | Run 2' | 3' | Run 4' | Run 5' | Run 6' | Run 7' |
| Processed Yarn (denier/filaments) | 150/20 | 150/30 | 150/38 | 150/72 | 120/48 | 80/36 | 75/36 |
| Starting Yarn (denier/filaments) | 290/20 | 290/30 | 290/48 | 290/72 | 234/48 | 156/36 | 126/36 |
| Twist Number (T/M) | 2450 | 2430 | 2470 | 2450 | 2680 | 3280 | 3480 |
| Number of Fluffs | 0 | 5 | 30 | 50 | 5 | 0 | 0 |
| CR (%) | 47 | 46 | 45 | 45 | 47 | 52 | 55 |
| Torque Twist Number (T/50M) | 52 | 55 | 58 | 60 | 52 | 50 | 49 |

From the results shown in Tables 6 and 7, it is seen that in runs 2, 3, 4 and 5 the present inventioned attained excellent effects as regards the crimp characteristics, fluffs and torque over comparative runs 2', 3', 4' and 5'. However, in runs 1, 6 and 7 better results were obtained as regards the crimp characteristics than in comparative runs 1', 6' and 7', but no substantial improvement was attained in connection with fluffs. All of the yarns obtained in the comparative runs had torques. From the forgoing, it will readily be understood that excellent effects of the present invention are fully manifested when in the resulting processed yarns, the total denier is at least 100 and the filament number is at least 30. The present invention is very effective when non-torque processed yarns having such total denier and filament number are manufactured.

EXAMPLE 10

This Example illustrates the above-mentioned process D of the present invention.

A polyethylene terephthalate drawn yarn of 75 denier/36 filaments and a polyamide (nylon 6) drawn yarn of 70 denier/24 filaments were simultaneously false twisted by using one 4-shaft outer contact type frictional false twisting apparatus, and the resulting false twisted yarns were doubled. The yarn was exposed to an air stream jetted from a fine hole to effect single yarn entanglement and subjected to the heat treatment to remove torques. Then, the yarn was wound.

The false twisting was carried out at a processing speed of 250 m/min. and a stretch ratio of −6%. A heater having a length of 2.4 m and maintained at 180° C. was used for setting twists.

The resulting yarn was subjected to circular knitting and the resulting knitted fabric was dyed with an acid dye (Anthraquinone Blue manufactured by Du Pont. The resulting dyed knitted fabric was relatively harsh and had a sprinkly colored appearance.

EXAMPLE 11

This Example illustrates the above-mentioned process E of the present invention.

Four-shaft outer contact type frictional false twisting apparatuses 24 shown in FIG. 8, including 6 frictional discs and 4-shaft outer contact type frictional false twisting apparatus 24' shown in FIG. 8, including 9 frictional discs were arranged alternately. The contact portion of each frictional disc was composed of a urethane rubber having a hardness of 96°. Each disc had a diameter of 49.5 mm and a thickness of 5 mm. Pre-oriented polyester yarns of 288 denier/48 filaments having a circular section were drawn-false twisted under the following conditions.

Processing speed: 400 m/min.

Heat treatment device temperature: 215° C

Heat treatment device length: 2.0 m

Draw ratio: 1.95

The doubling was carried out after processing according to the method 1 shown in FIG. 9.

Three special yarns having properties shown in Table 8 were obtained by adopting three rotation numbers of frictional discs shown in Table 8.

Table 8

| Rotation Number of Frictional Discs | Twist Tension/ Untwisting Tension in Apparatus 24 | Twisting Tension/ Untwisting Tension in Apparatus 24' | Resulting Doubled Yarn |
|---|---|---|---|
| 3000 rpm | 52 (g/d)/158 (g/d) | 54 (g/d)/70 (g/d) | special processed yarn having fluffs |
| 4500 rpm | 55 (g/d)/70 (g/d) | 56 (g/d)/57 (g/d) | mixed-crimp processed yarn |
| 6000 rpm | 56 (g/d)/57 (g/d) | 47 (g/d)/32 (g/d) | fancy yarn showing high gathering property intermittently |

What we claim is:

1. A method for simultaneously false twisting two yarns by using a false twisting apparatus comprising four rotational shafts, each including at least one frictional disc mounted thereon, and having two points where three discs overlap one another ichnographically, and contacting the two yarns at said overlapping points, respectively, said method comprising performing said contact of the two yarns at the overlapping points so that an angle defined by the rotational direction of the discs and the direction of advance of the yarn is an acute angle at each contact point, and winding the resulting false twisted yarns.

2. A method according to claim 1 wherein said four shafts are disposed so that they form four apexes of a quadrilateral, respectively, wherein the frictional discs on every two adjacent shafts overlap each other, and the frictional discs attached to a set of two shafts located on one of the two diagonal lines of said quadrilateral overlap each other.

3. A method for simultaneously false twisting yarns by use of a plurality of false twisting apparatus units, each unit twisting two yarns and comprising four rotational shafts, each of said rotational shafts including at least one frictional disc mounted thereon, and having two points where three discs overlap one another ichnographically, and contacting the two yarns at said overlapping points, respectively, said method comprising performing said contact of the two yarns at the overlapping points so that an angle defined by the rotational direction of the discs and the direction of advance of the yarn is an acute angle at each contact point, and winding the resulting false twisted yarns.

4. A method according to claim 3 wherein said four rotational shafts are disposed so that they form four apexes of a quadrilateral, the discs on every two adjacent shafts overlapping each other, and the frictional discs attached to a set of two shafts located on one of the two diagonal lines of said quadrilateral overlapping each other.

5. A method according to claim 4 wherein the two yarns which have been contacted with the frictional discs are doubled and then wound.

6. A method according to claim 5 wherein the two yarns false twisted by the same unit of the false twisting apparatus are doubled and then wound.

7. A method according to claim 5 wherein the two yarns false twisted by two different units of the false twisting apparatus are doubled and then wound.

8. A method according to claim 7 wherein the two yarns false twisted by two adjacent units of the false twisting apparatus are doubled and then wound.

9. A method according to claim 8 wherein the units of the false twisting apparatus are disposed so that S-twisting and Z-twisting are alternately carried out, one of the two yarns of a given twist direction false twisted by one unit is doubled with one of two yarns of the opposite twist direction false twisted by the adjacent unit and the doubled yarn is then wound.

10. A method according to claim 8 wherein the discs of the two adjacent units of false twisting apparatus have frictional characteristics differing from one another.

11. A method according to claim 5 wherein two yarns having different properties are false twisted and wound.

12. An apparatus for simultaneously false twisting two yarns, which comprises four rotational shafts, each of which has at least one frictional disc mounted thereon, said four shafts being disposed so that they form four apexes of a quadrilateral, respectively, wherein at least four frictional discs are attached stepwise in order from one shaft located at a lowermost position to adjacent shafts clockwise or counterclockwise so that the discs in every two adjacent shafts overlap each another, and the frictional discs attached to a set of two shafts located on one of the two diagonal lines of said quadrilateral overlap each other but the frictional discs attached to another set of the two shafts located on the other diagonal line do not overlap each other.

13. An apparatus as set forth in claim 12 wherein the shafts are rotated in the same direction.

14. An apparatus as set forth in claim 13 wherein at least one pair of adjacent shafts are rotated through a belt.

* * * * *